United States Patent [19]

Adachi

[11] Patent Number: 4,473,778

[45] Date of Patent: Sep. 25, 1984

[54] DISCHARGE LAMP STARTING DEVICE

[75] Inventor: Hiromi Adachi, Kanagawa, Japan

[73] Assignee: Mitsubishi Denki Kabushiki Kaisha, Tokyo, Japan

[21] Appl. No.: 437,596

[22] Filed: Oct. 29, 1982

[30] Foreign Application Priority Data

Oct. 30, 1981 [JP] Japan ..... 56-174245

[51] Int. Cl.[3] ..... H05B 39/00

[52] U.S. Cl. ..... 315/101; 315/209 R; 315/241 R; 315/290

[58] Field of Search ..... 315/101, 290, 241, 209 R

[56] References Cited

U.S. PATENT DOCUMENTS 4,347,462 8/1982 Adachi ..... 315/101

4,360,762 11/1982 Yamamoto et al. ..... 315/101

*Primary Examiner*—Harold Dixon

*Attorney, Agent, or Firm*—Sughrue, Mion, Zinn, Macpeak and Seas

[57] ABSTRACT

A discharge lamp circuit in which the lamp is substantially instantaneously started and in which the power consumption of the lamp after starting is reduced with substantially no vibration due to piezoelectric effects and caused by currents flowing through a nonlinear dielectric element. An inductive stabilizer is connected in series with one of the filaments of the discharge lamp and a nonlinear circuit is connected in parallel with the filaments of the discharge lamp. The nonlinear circuit is composed of a nonlinear dielectric element and a bidirectional switching means connected in parallel with the nonlinear dielectric element. A reverse-conductive circuit is connected in series with the nonlinear circuit and in parallel with the filaments of the discharge lamp, the reverse-conductive circuit including a reverse-conductive semiconductor switch mean which is conduction-controlled in the forward direction but which is always conductive in the reverse direction.

10 Claims, 13 Drawing Figures

FIG. 1 PRIOR ART
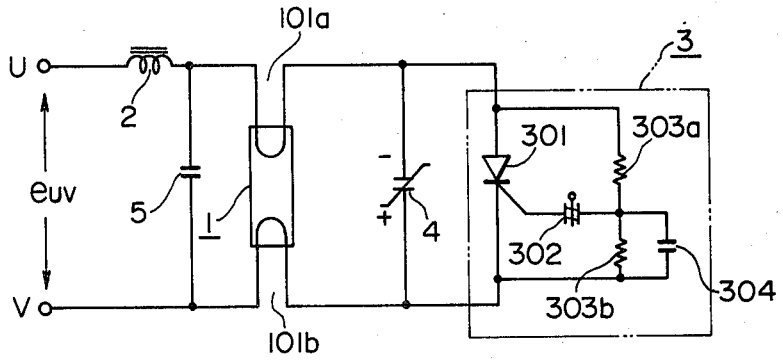
FIG. 2A PRIOR ART
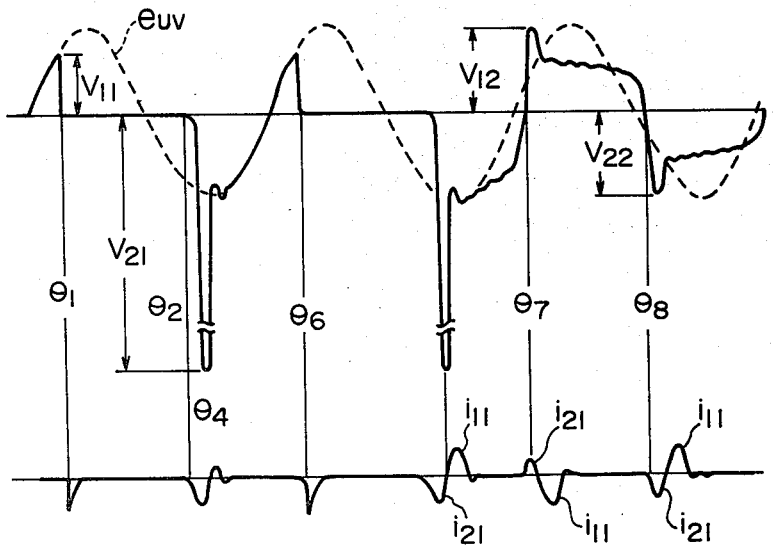
FIG. 2B PRIOR ART

DISCHARGE LAMP STARTING DEVICE

BACKGROUND OF THE INVENTION

The present invention relates to a starting device for a discharge lamp such as a fluorescent lamp. More particularly, the invention relates to a discharge lamp starting device utilizing semiconductor switching elements.

Various starters utilizing semiconductor switching elements have been heretofore proposed, of which one example utilizing a nonlinear dielectric element and a thyristor is shown in FIG. 1. In this figure, reference numeral 1 designates a discharge lamp including filaments 101*a* and 101*b* at opposite ends of the lamp; reference numeral 2 designates an inductive stabilizer; reference numeral 3 a semiconductor switch composed of a reverse blocking triode thyristor 301, a trigger element 302 such as an SBS (Silicon Bidirectional Switch) or Diac, voltage dividing gate circuit resistors 303*a* and 303*b*, and a smoothing capacitor 304; reference numeral 4 designates a nonlinear dielectric element; reference numeral 5 a noise eliminating capacitor; and reference characters U and V power source terminals.

In the above-described starter, when an AC voltage $e_{UV}$, having a waveform shown by a dotted line in FIG. 2A, is applied across the power source terminals U and V, at the beginning of the lamp starting period, the thyristor 301 turns on at a phase angle $\theta_1$ in a positive half cycle of the power source voltage. At that time, a current flows through a path including the stabilizer 2, filament 101*a*, thyristor 301, and filament 101*b*, thereby preheating the filaments. This current will lag the source voltage due to the inductive effect of the stabilizer 2. When the current flowing through the thyristor falls below the holding current of the device, the thyristor 301 turns off at a phase angle $\theta_2$, which occurs during the negative half cycle of the power source voltage. At the instant that the thyristor 301 is turned off, the voltage applied across the element 4 is zero. Since the power source voltage $e_{UV}$ is then in the proximity of the negative peak of the waveform, the element 4 is subsequently charged to the indicated polarity through the stabilizer 2.

The element 4 has a Q-V (stored charge vs. voltage) as shown in FIG. 3, wherein the stored charge becomes saturated at an applied saturation voltage $E_s$. By appropriately selecting the Q-V characteristic of the element 4, the nonlinear region (where the charged voltage is less than the saturation voltage $E_s$) is reached at a voltage less than the peak voltage of the power source. In this case, the charging current flowing into the element 4 is abruptly reduced at the instant the power source voltage exceeds the saturation voltage. Due to the inductive property of the stabilizer 2, the charged voltage of the element 4 then increases abruptly in the form of a pulse voltage $V_{21}$, as shown in FIG. 2A which is substantially higher than the peak voltage of the power source. The pulse voltage $V_{21}$ is applied across the discharge lamp 1. After the occurrence of this pulse voltage, the power source voltage $e_{UV}$ is applied across the lamp 1 until the thyristor 301 again turns off in the next cycle.

The above-described operation continues until the lamp 1 is started. That is, while the filaments 101*a* and 101*b* of the lamp 1 are being heated by the preheating current, the discharge of the lamp 1 is initiated by one of the positive pulse voltage V11 and the negative pulse voltage V21.

Once the lamp 1 has started, the lamp voltage is reduced below the power source voltage, thus keeping the thyristor 301 turned off. More specifically, although the lamp voltage instantaneously rises above the power source voltage, as shown by $V_{12}$ and $V_{22}$ in FIG. 2A, due to the charging effect of the element 4, the thyristor 301 cannot be turned on by voltages of the magnitude of $V_{12}$ because of the smoothing effect of the capacitor 304.

While the above-described starting device utilizing a nonlinear dielectric element and a thyristor is advantageous in its starting performance, simplicity of circuit construction, and low cost, nevertheless, the construction shown in FIG. 1 has following difficulties:

(1) The power consumption of the circuit is higher than in a starter in which the starter is disconnected from the lamp circuit after the lamp has been started.

(2) Charging and discharging currents flowing in and out of the element 4 create annoying vibration and noise due to piezoelectric effects.

More specifically, as shown in FIG. 2B, after the lamp 1 has been started (at phase angles $\theta_7$ and $\theta_8$, for instance), a discharge current $i_{11}$ flows through the element 4 and the lamp 1. Due to the presence of the discharge current $i_{11}$, the power consumption of the lamp 1 is considerably high in comparison with starter arrangements in which the starter is fully disconnected from the lamp circuit after the lamp has been started.

FIG. 4 illustrates a second example of a conventional starting device which is intended to overcome the above-described difficulties. In this figure, reference numeral 30 designates a bidirectional semiconductor switch, reference numeral 7*a* designates a diode connected in parallel with the element 4, and reference numerals 6 and 7*b* designate a series-connected resistor and diode connected in parallel with the semiconductor switch 3 to provide a discharge circuit for the switch 30. The semiconductor switch 30 is composed of a bidirectional triode thyristor 305, a trigger element 302 such as an SBS, Diac or the like, resistors 303*a* and 303*b*, and a capacitor 304.

The operation of the conventional device will now be described with reference to FIG. 5A which shows a voltage waveform across the lamp 1.

In the beginning of the starting operation, the thyristor 305 is turned on at a phase angle $\theta_1$ in a positive half cycle of the power source voltage $e_{UV}$, at which time a preheating current flows through a path including the stabilizer 2, filament 101*a*, diode 7*a*, thyristor 305, and filament 101*b*. The thyristor 305 is turned off at a phase angle $\theta_2$ in the following negative half cycle of the power source voltage $e_{UV}$, at which time the preheating current is reduced to zero. The thyristor 305 is again turned on thereafter at a phase angle $\theta_3$ by operation of the trigger element 302, thereby to create a charging current through the thyristor 305 and the element 4.

Because the element 4 has a nonlinear characteristic as in the case of the first example of the conventional device, when saturation is reached and the charging current of the element 4 drops at a phase angle $\theta_4$ to a value lower than that required for maintaining the thyristor 305 in the conductive state, the thyristor 305 is again turned off and the power source voltage is continuously applied across the lamp 1 until a phase angle $\theta_6$ in the positive half cycle, at which time the thyristor 305 is again turned on to pass the preheating current.

The purpose of the discharge resistor 6 and the diode *7b* is as follows. When saturation is reached at the phase angle $\theta_3$ causing an abrupt increase of the voltage across the element 4 to the maximum voltage $V_{21}$, the current through the element 4 then flows through the resistor 6 and the diode *7b*, thereby causing the voltage across the element 4 to substantially follow the lamp voltage. Since the voltage applied to the thyristor 305 is substantially equal to the difference between the charged voltage $V_{21}$ of the element 4 and the power source voltage $e_{UV}$, if there were no such discharge circuit, an extremely high voltage withstanding property would be required for the thyristor 305. Also, the diode *7b* prevents charging of the element 4 during the time interval between phase angles $\theta_2$ and $\theta_3$, thus ensuring the generation of the high voltage pulse $V_{21}$ by abruptly charging the element 4 starting from a zero potential.

Once the discharge lamp 1 has started, the lamp voltage is reduced below the power source voltage $e_{UV}$, thus preventing turning on of the thyristor 305 and maintaining stable operation of the lamp 1. Furthermore, since most of the power source voltage is applied across the thyristor 305, the voltage applied to the element 4 is reduced to approximately zero. Hence the drawbacks hereinbefore described with respect to the first example of the conventional device that are caused by charging and discharging currents of the element 4 after the lamp has been started are eliminated.

Unfortunately, however, as illustrated by FIG. 5B, the connection of the diode *7a* in parallel with the element 4 prevents positive voltages from being applied across the element 4. This causes the dielectric polarization of the element 4 to be shifted in one direction only, and hence the hysteresis loop of rectangular shape as shown in FIG. 3 is deformed to such an extent that the desired nonlinear characteristic of the element 4 is substantially lost. In other words, the amplitude of the pulse generated at the phase angle $\theta_4$ is reduced to such an extent that the starting of the discharge lamp is difficult.

An object of the present invention is thus to overcome the above-described drawbacks of the conventional discharge lamp starting devices.

More specifically, it is an object of the present invention to eliminate:

(1) the high power consumption due to charging and discharging currents of the element 4 and the accompanying generation of vibration from the element 4; and (2) the reduction of negative-side pulse voltages from the element 4.

SUMMARY OF THE INVENTION

In accordance with the above and other objects of the invention, there is provided a discharge lamp circuit arrangement including a discharge lamp, an inductive stabilizer serially connected with the discharge lamp, a nonlinear circuit connected in parallel with the discharge lamp composed of a nonlinear dielectric element and bidirectional switching means connected in parallel with the nonlinear dielectric element, and a reverse-conductive circuit element connected in series with the nonlinear circuit and in parallel with the discharge lamp. The reverse-conductive circuit element includes reverse-conductive semiconductor switch means which is conduction-controlled forwardly but which always is conductive in the reverse direction. An impedance element, specifically a resistor or capacitor, may be connected in parallel with the reverse-conductive semiconductor switch to reduce the maximum voltage applied thereto. The nonlinear circuit may further include a diode serially connected with the bidirectional switching means. The reverse-conductive semiconductor switching means may be a reverse-blocking triode thyristor and 2 diode connected in parallel with the reverse-blocking triode thyristor. Otherwise, the reverse-conductive semiconductor switching means may be a diode thyristor and a diode connected in parallel with the diode thyristor. The bidirectional switching means may be a diode thyristor.

With this circuit arrangement, the power consumption of the lamp circuit due to the starting circuitry is quite small. Also, currents flowing in and out of the nonlinear element, which could create undesirable mechanical noises due to vibration produced by piezoelectric effects, are not present after starting.

BRIEF DESCRIPTION OF THE DRAWINGS

FIG. 1 is a circuit diagram showing a first example of a conventional starter device;

FIG. 2A is a waveform diagram showing a voltage applied across the lamp of FIG. 1;

FIG. 2B is a waveform diagram showing charging and discharging currents of a nonlinear dielectric element used in FIG. 1;

DESCRIPTION OF THE PREFERRED EMBODIMENTS

A preferred embodiment of the present invention will now be described with reference to FIGS. 6 and 7.

Figure 6:
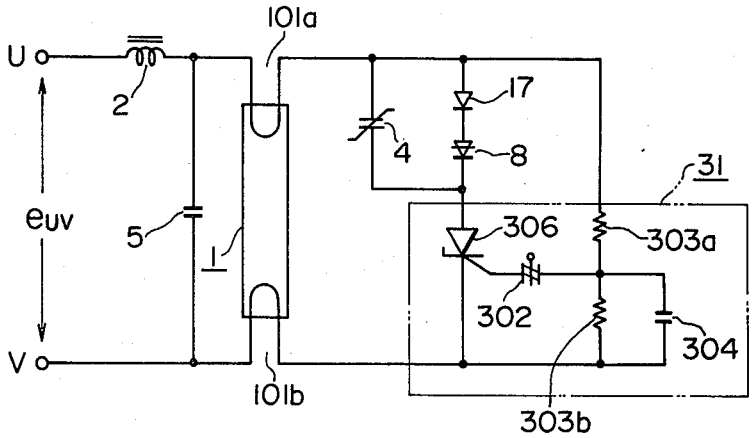
FIG. 6 is a circuit diagram showing a first preferred embodiment of discharge lamp starting device according to the present invention.
Figure 7A:
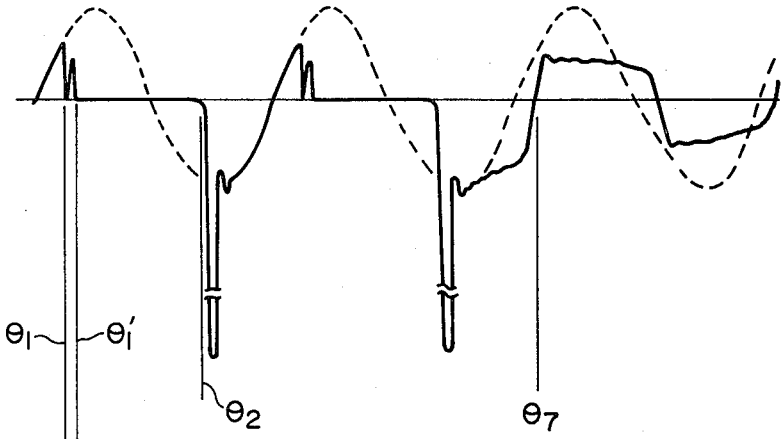
FIG. 7A is a waveform diagram of a voltage applied across the lamp of FIG. 6.

In FIG. 6, which shows a starting device for a discharge lamp in accordance with the invention, reference numeral 31 designates a reverse-conductive semiconductor switch which always conducts in the reverse direction, and reference numeral 306 designates a reverse-conductive triode thyristor, which is the primary operational element of the semiconductor switch 31. Reference numeral 17 designates a diode and reference numeral 8 a diode thyristor such as a PNPN switch, SSS (Silicon Symmetrical Switch) or the like, with the series combination of the diode 17 and diode thyristor 8 being connected in parallel with the element 4. Other components are similar to those described with reference to the conventional device shown in FIG. 1. FIG.

Figure 7B:
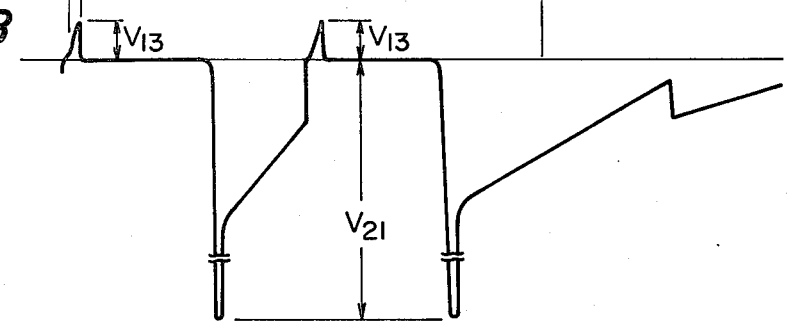
FIG. 7B is a waveform diagram of a voltage applied across the dielectric element.

7A is a waveform diagram of a voltage applied across the discharge lamp 1, and FIG. 7B is a waveform diagram of the voltage across the element 4.

The operation of the preferred embodiment of FIG. 6 will now be described.

In the beginning of the starting operation, the thyristor 306 turns on at a phase angle $\theta_1$ in a positive half cycle of the power source voltage $e_{UV}$, after which a current flows through a loop including the stabilizer 2, filament 101*a*, element 4, thyristor 306, and filament 101*b*. After the thyristor 306 is turned on, a voltage approximately equal to the power source voltage is applied across the diode thyristor 8. This voltage, which is lower than the breakdown voltage of the diode thyristor 8, is also applied across the element 4 as a positive-going voltage $V_{13}$. This positive-going voltage maintains the rectangular hysteresis characteristic of the element 4 and thus provide for the generation of a negative-going high-voltage pulse $V_{21}$.

During the application of the voltage nearly equal to the power source voltage, the thyristor 8 is turned on at the phase angle $\theta_1$, thereby causing a preheating current to flow through a loop including the stabilizer 2, filament 101*a*, diode 7, triode thyristor 8, thyristor 306, and filament 101*b*. This current lags the source voltage due to the inductive effect of the stabilizer 2. At the phase angle $\theta_2$, which occurs in the negative half cycle of the power source voltage $e_{UV}$ at the time when the preheating current falls below the holding current of the device, the thyristor 306 turns off. Since the voltage across the element 4 is zero at this instant, and as the power source voltage $e_{UV}$ is then close to its negative peak value, the element 4 is abruptly charged from the power source through a loop including the thyristor 306, element 4 and stabilizer 2 to a voltage far higher than the peak voltage of the power source. This pulsed voltage ($V_{21}$) is applied across the discharge lamp 1. After generation of the pulsed voltage $V_{21}$, the power source voltage $e_{UV}$ is applied to the lamp 1 until the thryristor 306 again turns on. The above-described operation is repeated until the lamp 1 starts.

Figure 3:
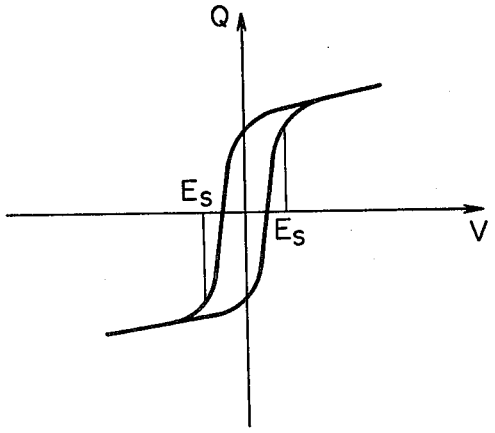
FIG. 3 is a graph showing the relationship between the voltage and the stored charge in the nonlinear dielectric element.
Figure 4:
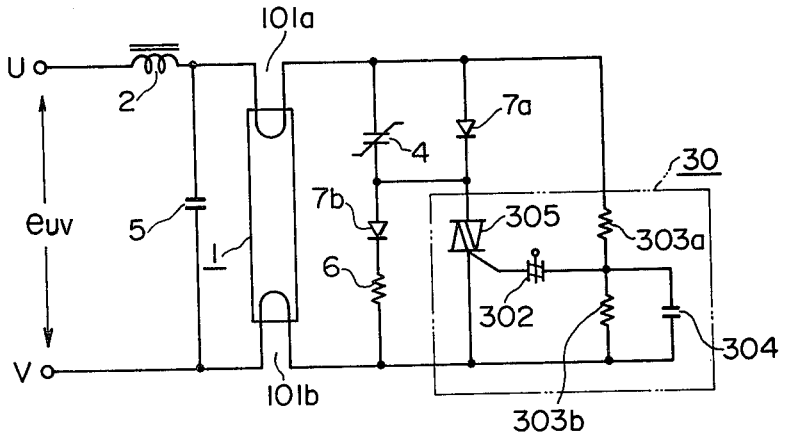
FIG. 4 PRIOR ART
FIG. 4 is a circuit diagram showing a second example of a conventional device.
Figures 5A, 5B:
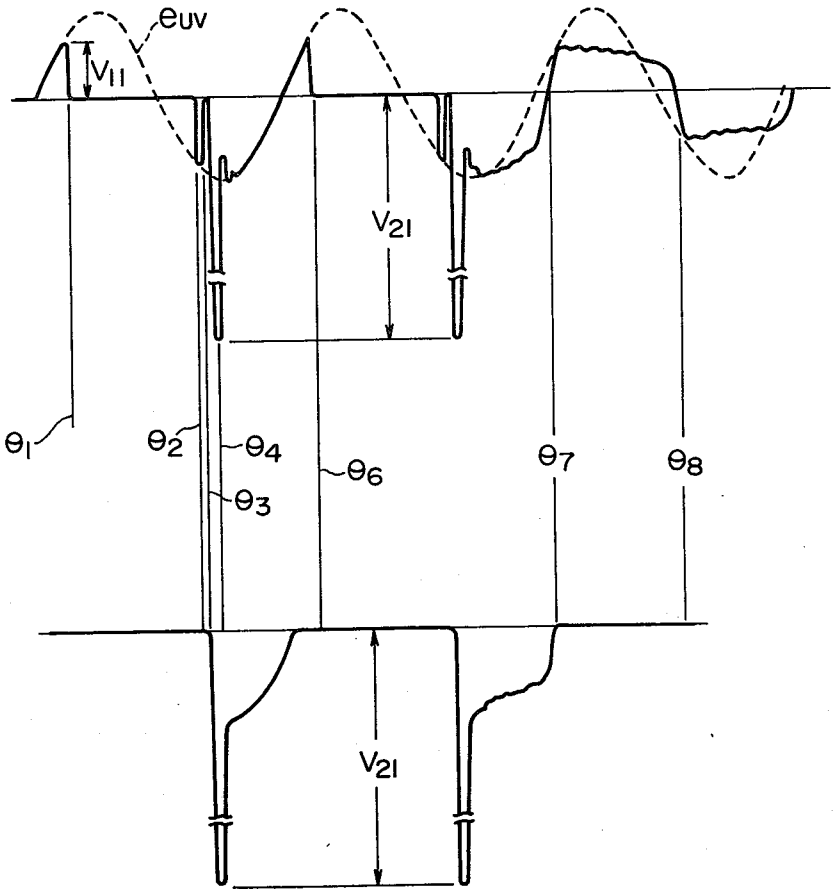
FIG. 5A PRIOR ART
FIG. 5B PRIOR ART
FIG. 5A is a waveform diagram showing a voltage applied across the lamp of FIG. 4.
FIG. 5B is a waveform diagram showing a voltage applied across the nonlinear dielectric element in FIG. 4.

After the lamp 1 has started, the thyristor 306 cannot be turned on, and a negative-going sawtooth waveform voltage is applied to the element 4. Because only a negative-going voltage is applied across the element 4 after starting, the dielectric material in the element 4 is then polarized in one direction only, as in the case of the second example of the conventional device, making it impossible to maintain the rectangular hysteresis characteristic shown in FIG. 3. During the starting operation though, as described above, the normal rectangular hysteresis characteristic is maintained.

Thus, in the circuit of the invention, the high power consumption of the lamp circuit after starting due to charging and discharging currents flowing through the element 4 and vibration due to piezoelectric oscillation of the element 4, which were present in the prior art constructions, are entirely eliminated. That is, because an alternating voltage is applied across the element 4 in the circuit of the invention during starting and only a direct voltage is applied thereafter, the rectangular hysteresis loop characteristics of the element 4 are maintained for starting so that a sufficiently high voltage pulse is produced for starting, while no vibration is generated after the lamp has been started. Also, because the thyristors 306 cannot be turned on after the lamp has started, the power consumption is reduced.

Figure 8:
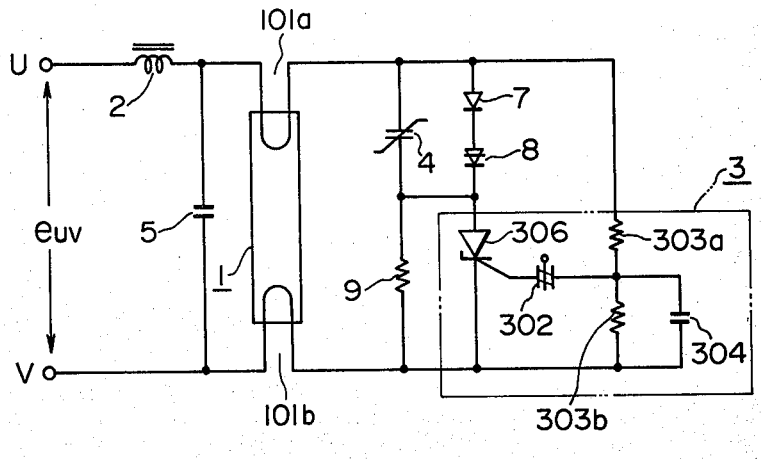
FIG. 8 is a circuit diagram showing a second embodiment of a starter device the present invention.

FIG. 8 illustrates another preferred embodiment of the present invention. This embodiment differs from the embodiments shown in FIG. 6 in that an impedance element 9, which may be either resistor or a capacitor, is connected in series with the element 4 and in parallel with the reverse-conductive thyristor 3. Similar to the resistor 6 in the second example of a conventional device, the impedance element 9 reduces the voltage-withstanding requirement of the thyristor 306.

Figure 9A:
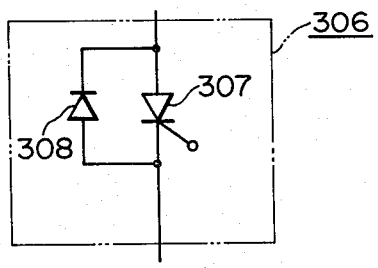
FIGS. 9A and 9B show other embodiments of a semiconductor switch used in the invention.
Figure 9B:
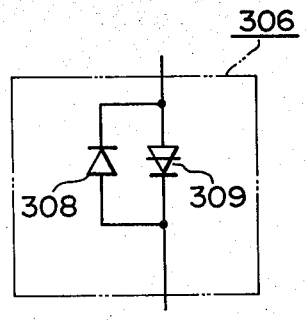

Although in the first and second preferred embodiments of the present invention the reverse-conductive thyristor 3 is described as being a reverse-conductive triode thyristor 306, the thyristor 306 may otherwise be implemented with a combination of a reverse-blocking triode thyristor 307 and a diode 308 as shown in FIG. 9A, or a combination of a diode thyristor 309 and a diode 308 as shown in FIG. 9B while still obtaining the advantages of the present invention.

In a discharge lamp starting device according to the present invention utilizing a nonlinear dielectric element, a diode thyristor is connected in parallel with the dielectric element. With this arrangement, reduction of the pulse voltage generated across the nonlinear dielectric element is prevented due to the positive-going voltage applied across the nonlinear element. Furthermore, due to the provision of the reverse-conductive thyristor in series with the dielectric element 4, a charging effect is provided for the element 4 so as to reduce the power consumption of the lamp and the noise generated from the element 4 after the lamp has been started. These features overcome the drawbacks of the prior art approaches and thus enhance the utility of the present invention.

I claim:

1. A discharge lamp device comprising: a discharge lamp; an inductive stabilizer connected in series with said discharge lamp; a nonlinear circuit connected in parallel with said discharge lamp and comprising a nonlinear dielectric element and bidirectional switching means connected in parallel with said nonlinear dielectric element; and a reverse-conductive circuit connected in series with said nonlinear circuit and in parallel with the discharge lamp, said reverse-conductive circuit comprising reverse-conductive semiconductor switch means conduction-controlled forwardly and always conductive reversely.

2. The discharge lamp device as set forth in claim 1, wherein said nonlinear circuit further comprises a diode serially connected with said bidirectional switching means.

3. The discharge lamp device as set forth in claim 1, wherein said reverse-conductive semiconductor switching means comprises a reverse-blocking triode thyristor and a diode connected in parallel with said reverse-blocking triode thyristor.

4. The discharge lamp device as set forth in claim 1, wherein said reverse-conductive semiconductor switching means comprises a diode thyristor and a diode connected in parallel with said diode thyristor.

5. The discharge lamp device as set forth in claim 1, wherein said bidirectional switching means comprises a diode thyristor.

6. A discharge lamp device comprising: a discharge lamp; an inductive stabilizer connected in series with a filament of said discharge lamp; a nonlinear circuit connected in parallel with filaments of said discharge lamp and comprising a nonlinear dielectric element and a bidirectional switching means connected in parallel with said nonlinear dielectric element; and a reverse-conductive circuit connected in series with said nonlinear circuit and in parallel with the discharge lamp, said reverse-conductive circuit comprising reverse-conductive semiconductor switch means conduction-controlled forwardly and always conductive reversely, and an impedance element connected in parallel with said reverse-conductive semiconductor switch.

7. The discharge lamp device as set forth in claim 6, wherein said nonlinear circuit further comprises a diode connected in series with said bidirectional switching means.

8. The discharge lamp device as set forth in claim 6, wherein said reverse-conductive semiconductor switching means comprises a reverse-blocking triode thyristor and a diode connected in parallel with said triode thyristor.

9. The discharge lamp device as set forth in claim 6, wherein said reverse-conductive semiconductor switching means comprises a diode thyristor and a diode connected in parallel with said diode thyristor.

10. The discharge lamp device as set forth in claim 6, wherein said bidirectional switching means comprises a diode thyristor.

* * * * *